US005695294A

United States Patent [19]

Bedol et al.

[11] Patent Number: 5,695,294

[45] Date of Patent: Dec. 9, 1997

[54] STORAGE APPARATUS FOR RINGED NOTEBOOK OR RINGED BINDER

[75] Inventors: Mark A. Bedol, 6890 Fabriano Pl., Rancho Cucamonga, Calif. 91701; Doug Noyes, Upland, Calif.

[73] Assignee: Mark A. Bedol, Claremont, Calif.

[21] Appl. No.: 537,436

[22] Filed: Oct. 2, 1995

[51] Int. Cl.[6] ..... B42F 13/00

[52] U.S. Cl. ..... 402/79; 402/4; 402/80 R

[58] Field of Search ..... 281/30, 38, 51; 402/1, 4, 79, 80 R, 80 L

[56] References Cited

U.S. PATENT DOCUMENTS

| | | | |
|---|---|---|---|
| 1,039,296 | 9/1912 | Krumming | 281/30 X |
| 1,308,437 | 7/1919 | Metcalfe | 281/30 |
| 1,894,241 | 1/1933 | Raynolds | 402/80 L |
| 1,904,572 | 4/1933 | Trussell | 402/4 |
| 2,097,626 | 11/1937 | Lesti | 402/4 |
| 2,160,392 | 5/1939 | Schade . | |
| 2,184,823 | 12/1939 | Vernon . | |
| 2,194,003 | 3/1940 | Brooks . | |
| 2,200,146 | 5/1940 | Block | 281/30 |
| 2,223,560 | 12/1940 | Brooks | 281/31 |
| 2,276,987 | 3/1942 | Kengott . | |
| 2,318,192 | 5/1943 | Boelema | 281/31 |
| 2,453,459 | 11/1948 | Roberts | 402/80 L |
| 2,505,694 | 4/1950 | Stuercke | 402/80 L |
| 2,647,517 | 8/1953 | Bilbrey . | |
| 2,673,099 | 3/1954 | Hamilton | 281/30 |
| 2,704,077 | 3/1955 | Prillaman . | |
| 2,821,197 | 1/1958 | Bilbrey . | |
| 3,126,891 | 3/1964 | Caputi . | |
| 3,366,118 | 1/1968 | Beyer | 402/80 L |
| 4,555,018 | 11/1985 | Cho | 206/214 |
| 4,820,071 | 4/1989 | Steinfield et al. | 402/4 |
| 4,909,562 | 3/1990 | Harrison | 402/80 R |
| 4,918,632 | 4/1990 | York | 364/708 |
| 5,058,736 | 10/1991 | Bedol | 281/31 X |
| 5,118,138 | 6/1992 | Brotz | 402/80 R X |
| 5,209,592 | 5/1993 | Bedol | 402/1 |
| 5,460,414 | 10/1995 | Sargis | 402/80 R X |
| 5,476,336 | 12/1995 | Osiecki et al. | 402/4 X |
| 5,498,089 | 3/1996 | Motyka | 402/4 |
| 5,503,489 | 4/1996 | Maudal | 402/80 R X |
| 5,597,256 | 1/1997 | Burton et al. | 402/4 |

FOREIGN PATENT DOCUMENTS

| | | | |
|---|---|---|---|
| 835316 | 12/1938 | France | 402/4 |
| 64148 | 10/1955 | France | 402/4 |
| 1396190 | 3/1965 | France | 402/4 |
| 2575419 | 7/1986 | France | 402/80 R |
| 817440 | 10/1951 | Germany | 402/4 |
| 17022 | of 1909 | United Kingdom | 402/4 |
| 7081 | of 1910 | United Kingdom | 281/30 |
| 11652 | 5/1912 | United Kingdom | 281/30 |
| 217484 | 6/1924 | United Kingdom | 402/4 |
| 1564220 | 4/1980 | United Kingdom | 281/30 |

*Primary Examiner*—Willmon Fridie, Jr.

[57] ABSTRACT

An apparatus for storing items in the volume formed within the rings of a ringed notebook or ringed binder. A main plate member having a plurality of spaced openings therethrough is provided. The spaced openings are arranged and sized so as to accommodate the rings of a ringed notebook or a ringed binder. A storage mechanism is provided for storing at least one selected item. The storage mechanism extends from the main plate member into the volume formed within the rings. Thus, this volume, which is normally unused, can be utilized to store the selected item. In one embodiment the storage mechanism includes a snap on holder. This snap on holder may comprise a storage plate member, locking mechanism and a storage item receiving element. The locking mechanism is associated with the storage plate member for securely attaching the storage plate member to the main plate member. The storage item receiving element extends from a first end of the storage plate member wherein during use of the apparatus the storage item receiving element extends into the volume formed within the rings. In a second embodiment, the storage mechanism is integrally connected to the main plate member.

29 Claims, 7 Drawing Sheets

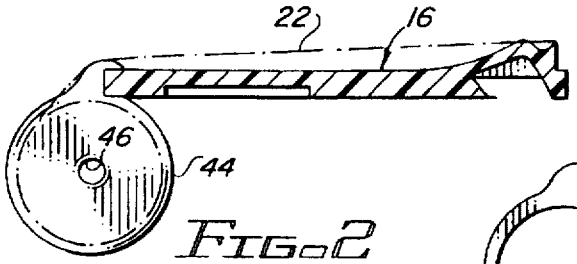
FIG. 2
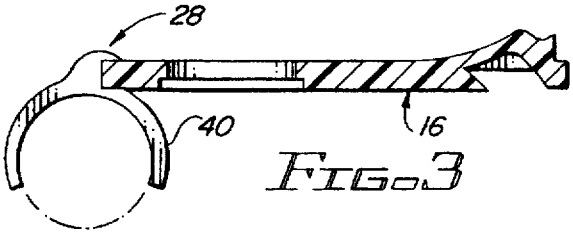
FIG. 3
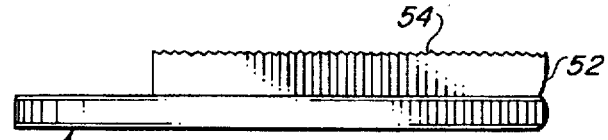
FIG. 4
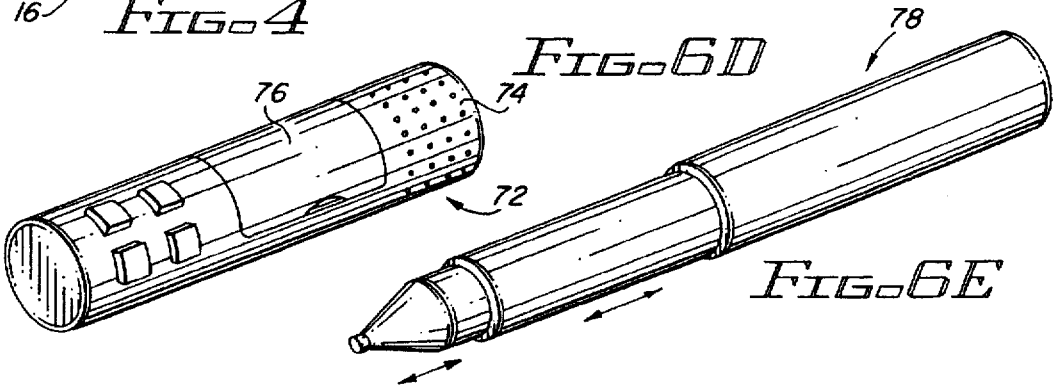
FIG. 6D
FIG. 6E
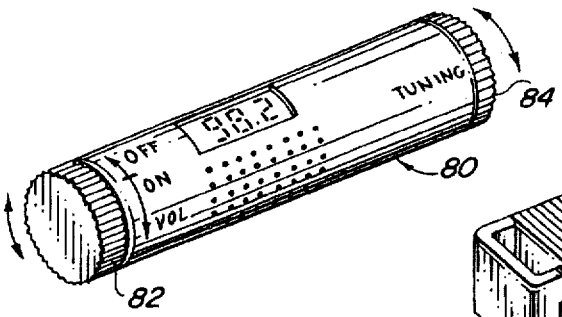
FIG. 6F
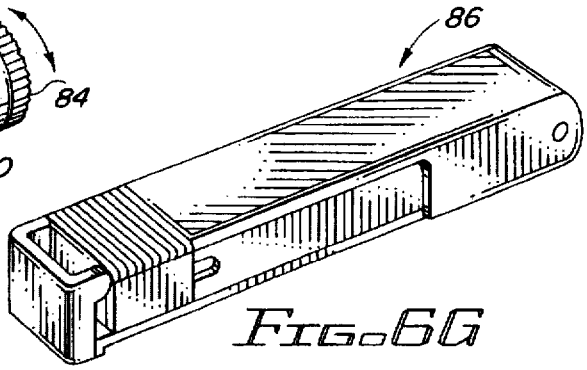
FIG. 6G
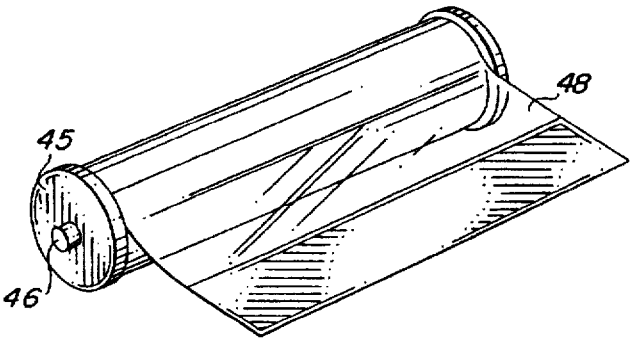
FIG. 6H
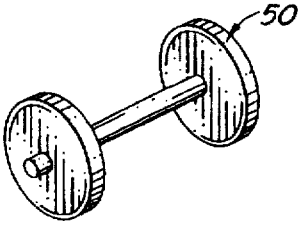
FIG. 6I

STORAGE APPARATUS FOR RINGED NOTEBOOK OR RINGED BINDER

BACKGROUND OF THE INVENTION

1. Field of the Invention

The present invention relates to inserts for ringed notebooks and ringed binders and, more particularly, to a notebook insert which provides a storage mechanism within the volume formed within the rings of the notebook or binder, for storing various selected items.

2. Description of the Related Art

Users of notebooks, including businessmen and students, often desire to have various articles such as pencils and pens at their easy disposal when they use their notebook and to be secure from being lost when they carry their notebooks from one location to another. In partial solution to this problem, present applicant Mark A. Bedol, invented a "Notebook Organizer Including Slidable Element", U.S. Pat. No. 5,058,736. The U.S. Pat. No. 5,058,736 patent discloses an organizer comprising a base with holes for engagement with the rings of a ringed notebook. The base includes a plurality of partitions which divide the base into a plurality of compartments. The patent also discloses an electronic calculator having a longitudinal extension thereon being slidably engageable with, and supported between, opposing partition surfaces.

Present applicant Mark A. Bedol, has also invented "Notebook Insert With Calculator and Holepunch", U.S. Pat. No. 5,209,592, which discloses a notebook insert comprising a housing, an electronic calculator attached to the housing and a holepunch assembly also attached to the housing. The housing has a periphery with multiple holes therethrough which are spaced to be adapted for engagement with the rings of a ringed notebook.

Although these prior art devices are effective in attempting to maximize the usable space within a notebook, they have not exploited the volume within the rings of the notebook.

OBJECTS AND SUMMARY OF THE INVENTION

It is, therefore, a principal object of the present invention to provide optimal utilization of all of the space within a ringed notebook or ringed binder.

The present invention is an apparatus for storing items in the volume formed within the rings of a ringed notebook or ringed binder. A main plate member having a plurality of spaced openings therethrough is provided. The spaced openings are arranged and sized so as to accommodate the rings of a ringed notebook or a ringed binder. Storage means is provided for storing at least one selected item. The storage means extends from the main plate member into the volume formed within the rings. Thus, this volume, which is normally unused, can be utilized to store the selected item.

In one embodiment the storage means comprises a snap on holder. This snap on holder may comprise a storage plate member, locking means and a storage item receiving element. The locking means is associated with the storage plate member for securely attaching the storage plate member to the main plate member. The storage item receiving element extends from a first end of the storage plate member wherein during use of the apparatus the storage item receiving element extends into the volume formed within the rings.

In a second embodiment, the storage means is integrally connected to the main plate member.

As will be explained below, a variety of different items can be secured by the apparatus of the present invention.

Other objects, advantages, and novel features will become apparent from the following detailed description of the invention when considered in conjunction with the accompanying drawings.

BRIEF DESCRIPTION OF THE DRAWINGS

FIG. 2 is a view taken along Line 2—2 of FIG. 1.

FIG. 3 is a view taken along Line 3—3 of FIG. 1.

FIG. 4 is a view taken along Line 4—4 of FIG. 1.

FIG. 6D shows a recording device that may be used; FIG. 6E shows a telescoping ballpoint pen which may be stored; FIG. 6F shows a radio that can be stored; FIG. 6G shows a stapler that can be stored; FIG. 6H shows a full reel of a roll of material that can be stored; and FIG. 6I shows an empty small reel that can be stored.

The same parts or elements throughout the drawings are designated by the same reference characters.

DETAILED DESCRIPTION OF THE PREFERRED EMBODIMENTS

Figure 1:
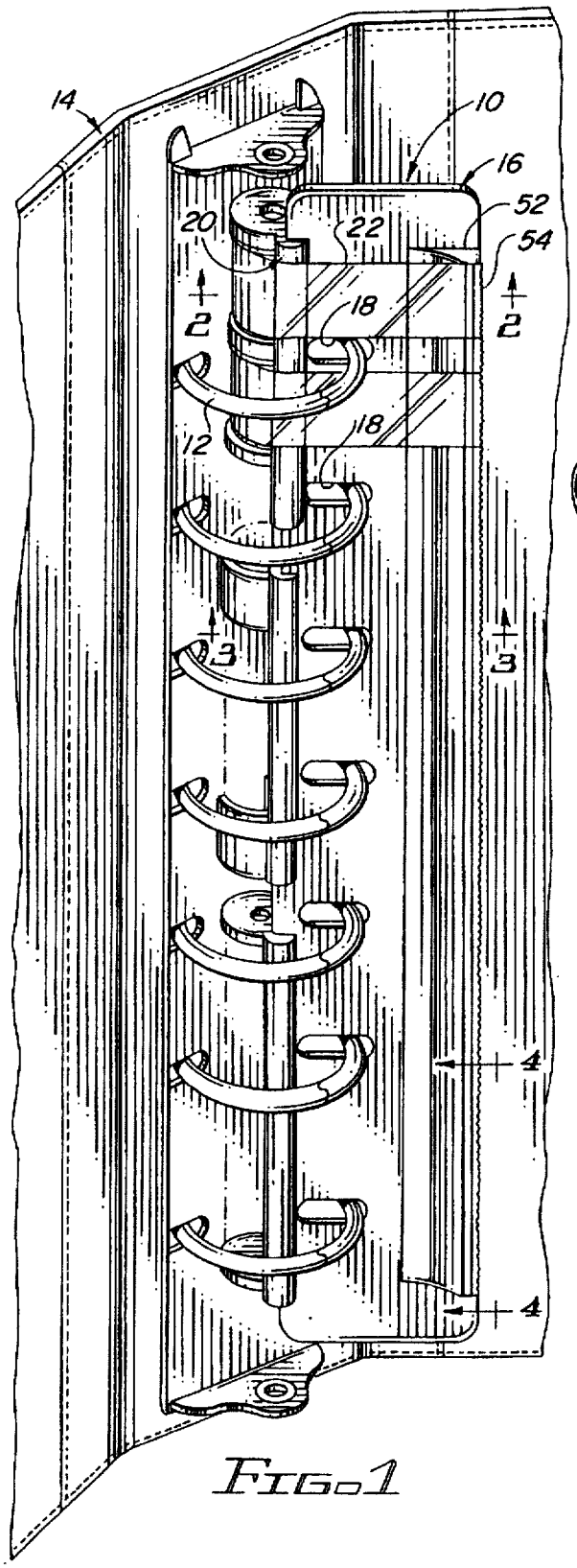
FIG. 1 is a front perspective view of a first embodiment of the present invention, utilized with a seven-hole ringed notebook, the invention being used to store a tape holder.

Referring now to the drawings and the characters of reference marked thereon, FIG. 1 illustrates a first embodiment of the apparatus of the present invention designated generally as 10, shown attached to the rings 12 of a conventional ringed binder, designated generally as 14. The apparatus 10 includes a main plate member, designated generally as 16 having a plurality of spaced openings 18 therethrough (in this instance seven openings 18). The openings 18 are arranged and sized so as to accommodate the rings 12 of a ringed notebook or a ringed binder. Storage means, as indicated generally as 20, is utilized to store a selected item, for instance, in the embodiment shown in FIG. 1, a roll of tape 22. The storage means 20, as will be explained in detail below, extends from the main plate member 16 into the volume formed within the rings 12 so that the volume, which is normally unused, can be utilized to store the selected item, i.e., tape 22.

Figure 7:
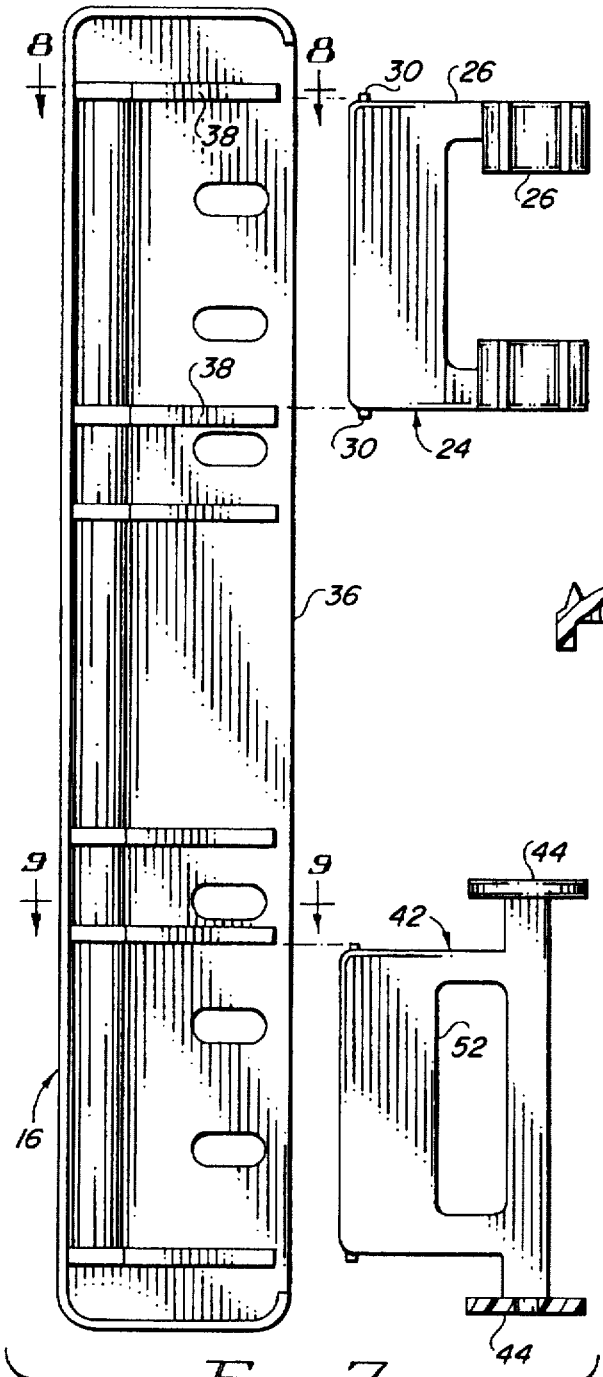
FIG. 7 is a rear plan view of a second embodiment of the present invention in which the main plate member has six holes to accommodate a similarly designed six-hole ringed notebook, this view showing how the snap on holder becomes secured.
Figure 9:
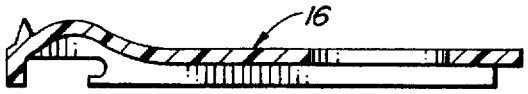
FIG. 9 is a view taken along 9—9 of FIG. 7.

Referring now to FIG. 7, a first type of storage means 20 is shown, which involves use of a snap on holder, designated generally as 24. The snap on holder 24 includes a storage plate member 26, locking means, and a storage item receiving element 28. The storage item receiving element 28 extends from a first end of the storage plate member 24 wherein during use of the apparatus 10, the storage item receiving element 28 extends into the volume formed within the rings.

Figure 8:
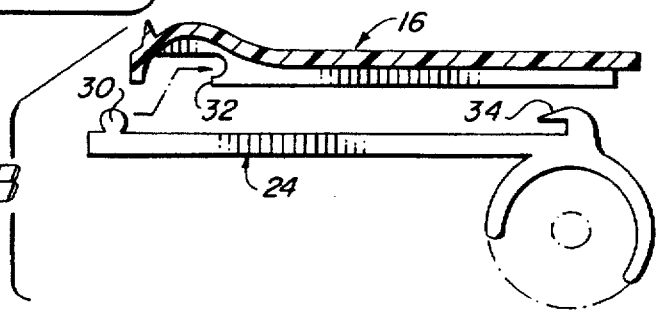
FIG. 8 is a view taken along Line 8—8 of FIG. 7, illustrating the locking mechanism of the present invention.
Figure 12:
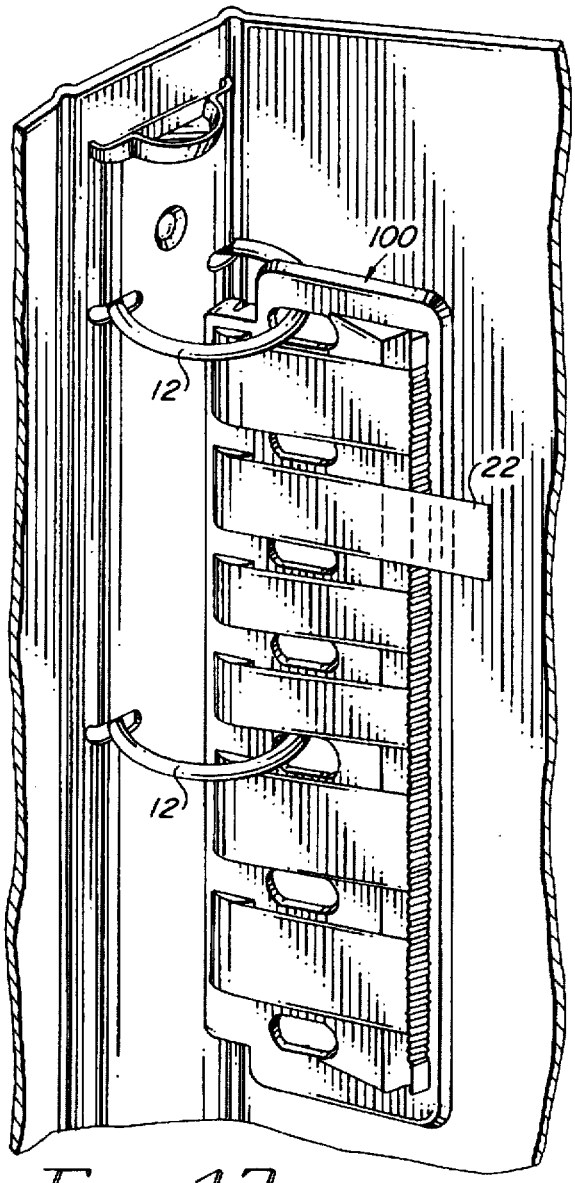
FIG. 12 is a front perspective view of another embodiment of the present invention in which the storage means is integrally connected to the main plate member, the invention shown connected to a ringed notebook.
Figure 13:
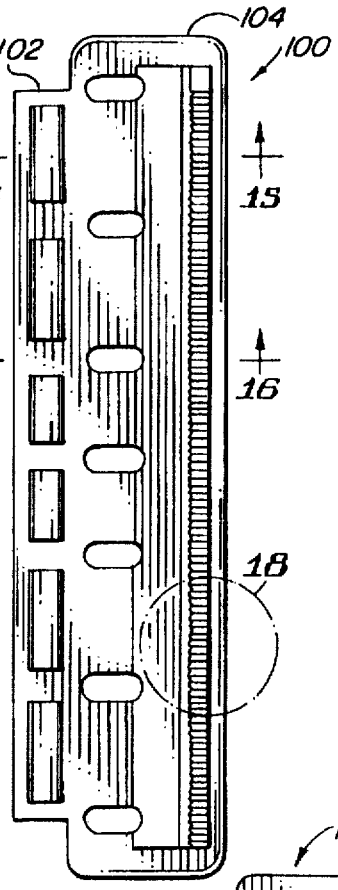
FIG. 13 is a front plan view of the embodiment of FIG. 12.
Figure 14:
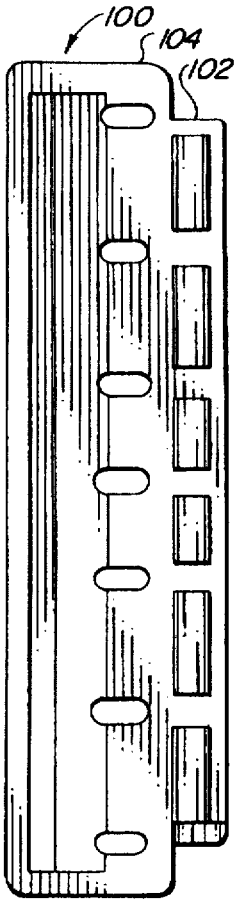
FIG. 14 is rear plan view thereof.
Figure 15:
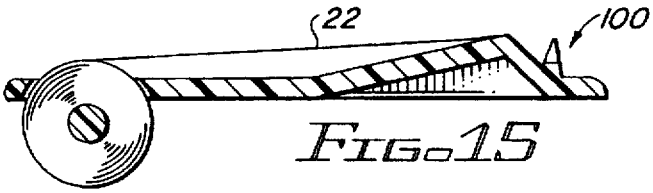
FIG. 15 is a view taken along Line 15—15 of FIG. 13.
Figure 16:
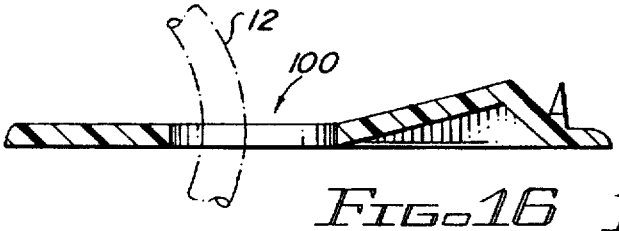
FIG. 16 is a view taken along Line 16—16 of FIG. 13.
Figure 17:
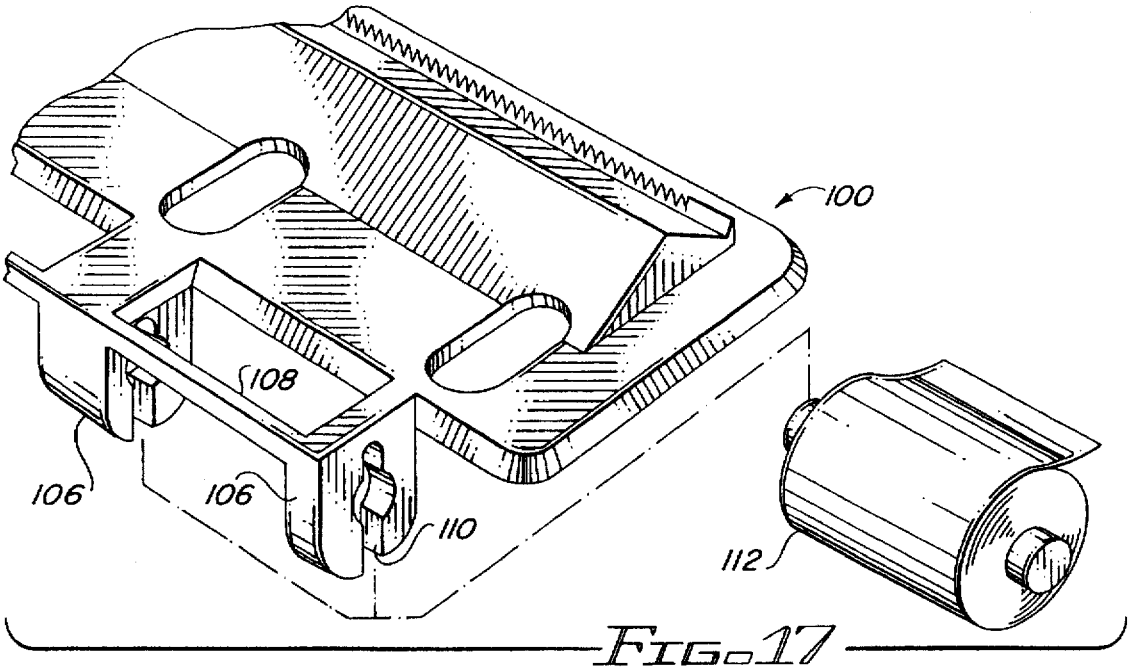
FIG. 17 is a perspective view illustrating how a roller is inserted in the slotted arms of the FIG. 12 embodiment.
Figure 18:
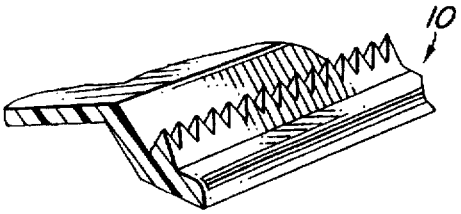
FIG. 18 is a perspective view of a portion of the cutting element of the FIG. 12 embodiment, with a serrated edge, taken along Section 18 of FIG. 13.
Figure 23:
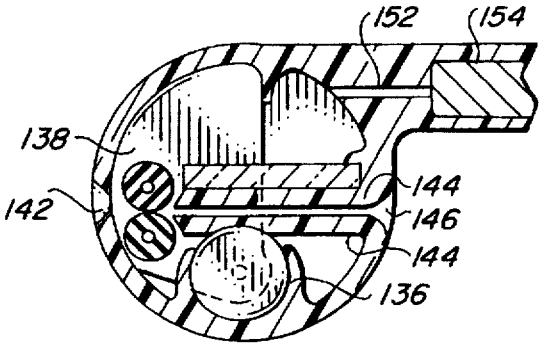
FIG. 23 is a view taken along Line 23—23 of FIG. 22.
Figure 24:
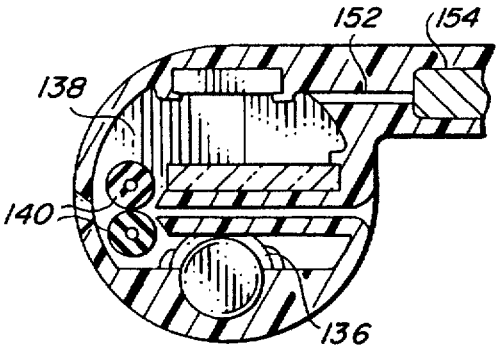
FIG. 24 is a view taken along Line 24—24 of FIG. 22.

The locking means comprises a pair of tabs 30 on a second end of the storage plate member 24 for engagement with tab reception elements 32 (best seen in FIG. 8) formed on a rear surface of the main plate member 16. The locking means also preferably includes an edge receiving tab element 34 (also best seen in FIG. 8) positioned on the storage plate member 24 for engagement with a portion of the edge 36 of the main plate member 16. Thus, by use of the locking mechanism described, the snap on holder 24 can be securely positioned on the main plate member 16. Movement in the orthogonal direction is prevented by the guideways 38 formed on the main plate member 16.

Figure 6A:
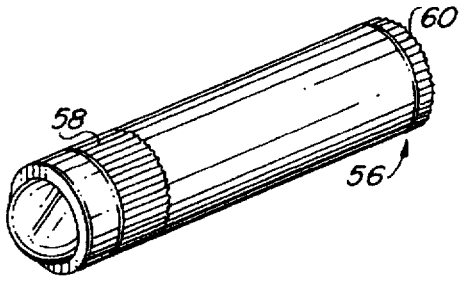
FIG. 6A is a perspective view of a small flashlight which can be stored by the apparatus of the present invention.

The storage item receiving element may comprise different embodiments. For example, the storage item receiving element 28 comprises a pair of spaced, generally U-shaped cylinder receiving elements 40 (best seen in FIG. 3) for receiving the selected item, the selected item in this instance having a cylindrical shape. In the lower part of FIG. 7, a second type of storage item receiving element is illustrated, designated generally as 42. Element 42 comprises a pair of opposed spaced, circular reel receiving elements 44 (see also FIG. 2). Each element 44 has a central opening 46 therethrough for receiving a post of a reel. Referring now to FIG. 6H, such a reel is illustrated, the post thereof being designated as 46. The reel 45 is shown with a relatively full roll 48 of material. Such material may be, for example, tape or paper with a tacky back surface.

Figure 5:
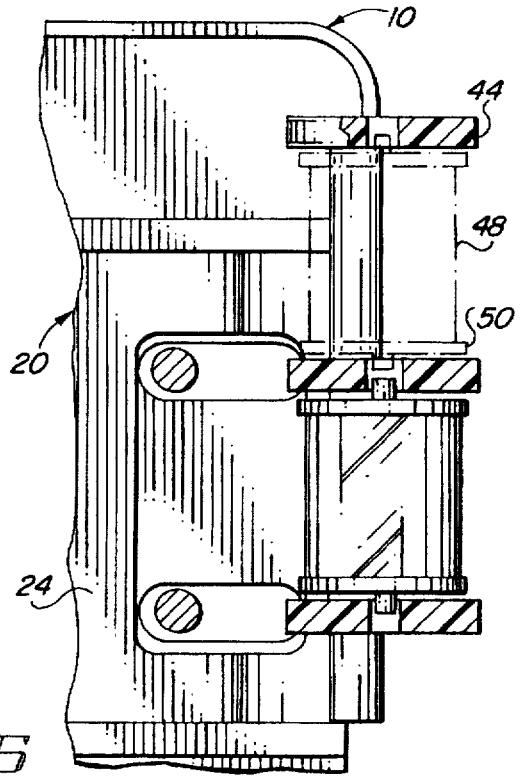
FIG. 5 is a rear view of a portion of the upper end of the apparatus of FIG. 1.

As illustrated in FIG. 61, the inventive concepts herein are not limited to a particular size reel, and in fact, a relatively small reel 50 may be used. The utilization of different sizes is constrained by the spacing of the guideposts 38 and also the location of the openings 18. Thus, for example, storage plate member 42 includes an opening 52 (see FIG. 7) formed therein to accommodate the rings 12. This association of elements can be best seen by reference to FIG. 5, in which the storage plate member 24 is shown in place.

Referring again now to FIGS. 1–4, the contour of the front surface of the storage plate member 16 can be seen. Storage plate member 16 includes a cutting element 52 formed thereon with a serrated edge 54. This cutting element 52 provides convenient cutting of the tape 22.

Various cylindrical items are shown in FIGS. 6A–6F to illustrate the variety of items that may be stored. 6A shows a flashlight 56, which may include a rotatable on/off switch 58 and a screwable battery access 60.

Figure 6B:
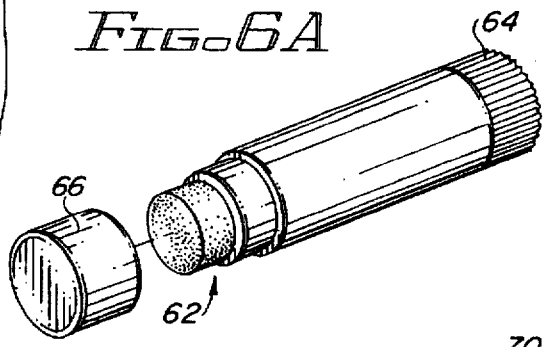
FIG. 6B is a perspective view of a glue stick or lipstick which can be stored utilizing the present invention.

FIG. 6B shows an item which may be, for example, a glue stick or lipstick 62 with a rotatable actuator 64 and cap 66.

Figure 6C:
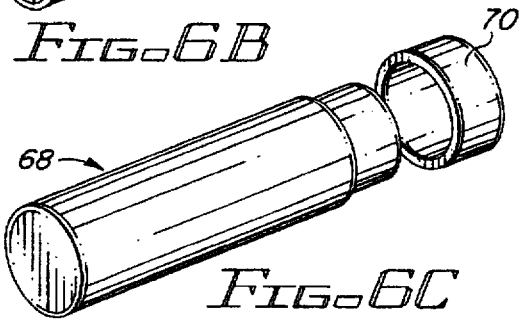
FIG. 6C shows a pill container which can be stored utilizing the present invention.

FIG. 6C shows a pill container 68 with a removable cap 70.

FIG. 6D shows a recording device 72 with microphone 74 and access cover 76 to the tape reel.

FIG. 6E illustrates a writing instrument, which may comprise, for example, a telescoping ballpoint pen.

FIG. 6F illustrates a cylindrical radio 80 with rotatable on/off and volume switch 82 and tuning switch 84.

Figure 6J:
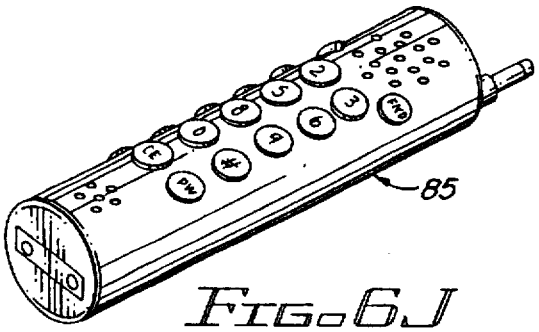
FIG. 6J, illustrates a cellular telephone which may be stored.

FIG. 6J illustrates a cellular telephone 85.

The principles of the present invention are not limited to items having cylindrical cross-sections. For example, with receiving arms 28, of the proper geometry, other shaped objects may be stored, for example, a small stapler 86 as illustrated in FIG. 6G.

Figure 10:
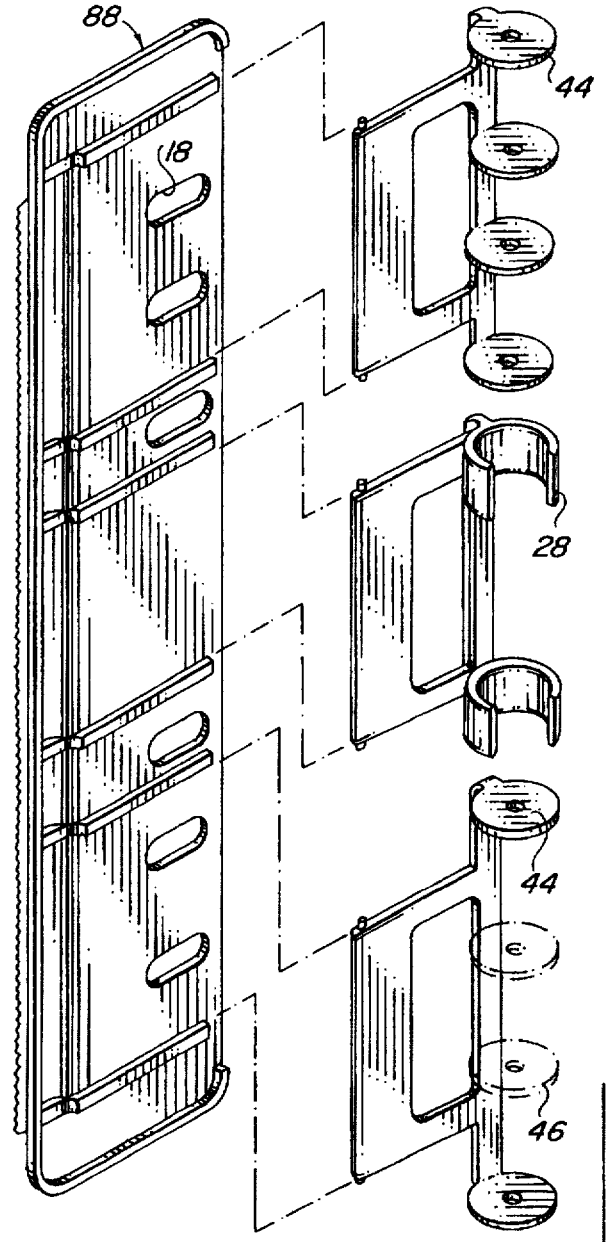
FIG. 10 is a rear perspective view of the six-hole main plate member utilized with a variety of snap on holders.

Also, as emphasized in FIG. 1, different storage items may be utilized with the same storage plate member 16. FIG. 10 also illustrates the variations of snap on holders possible with the present invention. First it is noted that FIG. 10 involves the use of a main plate member 88 with six openings 18. The receiving elements 28, 44 can be varied in accordance with the spacings inherent with the opening 18 spacings. Different alternatives are available, as indicated by phantom lines 46.

Figure 11:
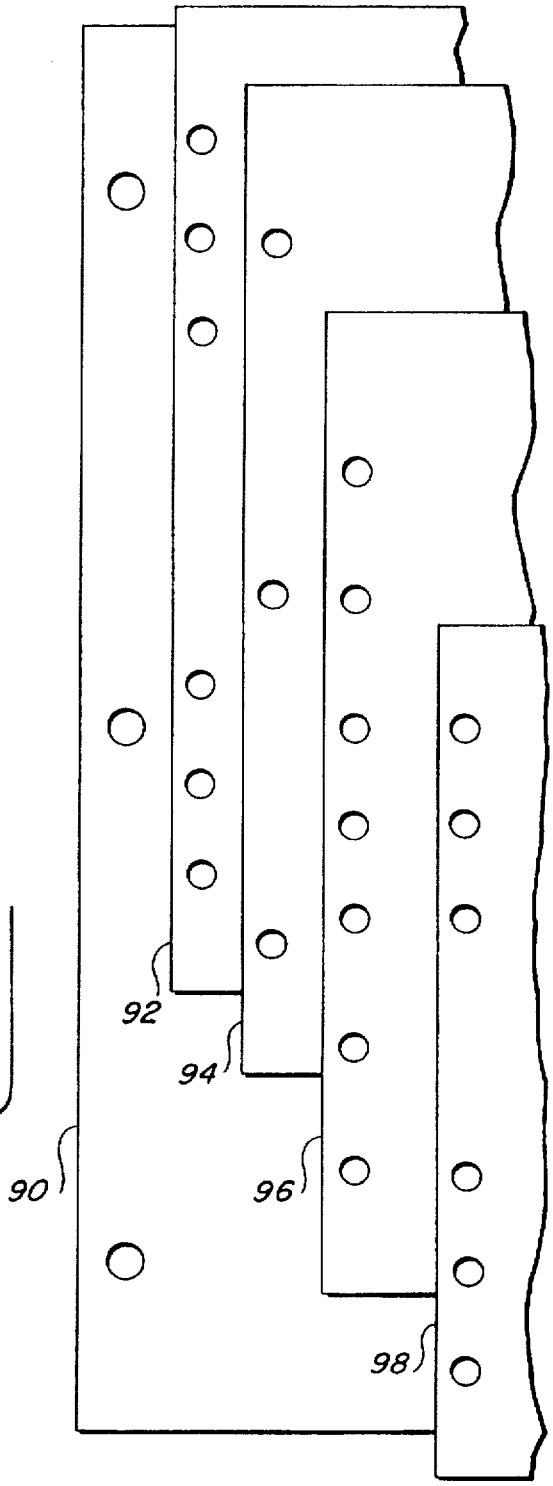
FIG. 11 illustrates an assortment of hole patterns of main plate members which can be used.

FIG. 11 illustrates the assorted hole patterns that may be utilized for the main plate members in accordance with the variety of ringed notebooks and ringed binders that are commercially available. Member 90 is a large three-hole member. Member 92 is of the six-hole. type. Member 94 is a relatively small three-hole type. Member 96 is of the seven-hole type. Member 98 is a six-hole type.

Referring now to FIGS. 12–18, another embodiment of the present invention is illustrated, designated generally as 100. In this embodiment, the storage means (i.e., reel receiving elements 102 are integrally connected to the main plate member 104). Furthermore, the spaced arms 106 are integrally connected by elements 108. Arms 106 include slots 110 for holding the reels 112.

Referring now to FIGS. 19–24, another embodiment of the present invention is illustrated, designated generally as 120, comprising a document scanner. The document scanner 122 may comprise a fax.

The scanner 120 includes a housing 122 including a thin substantially flat portion 124 containing an LCD display 126, control panel 128, and a keyboard panel 130. Cylindrical storage portion 132 of the housing 122 fits within the volume formed within the rings 12 of the binder 14.

Batteries 134 provide power to a motor 136. The motor 136 may be, for example, a DC motor with encoders to determine the position of the paper or a stepper motor which does not require encoders. The motor 136 drives via gearbox 138, rollers 140 for passing paper therebetween.

During operation, paper is inserted through an inlet slot 142 and is passed between paper guide 144 and through an outlet slot 146. A lens 148 formed of a clear plastic or glass material focuses the image on a charged coupled device (see CCD) 150. (It is noted that an optional additional mirror could be used to direct the image to a different CCD location than that shown to provide a larger focal area.)

Figure 20:
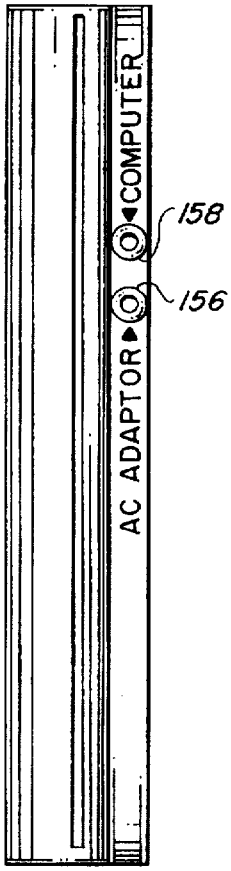
FIG. 20 is a side view taken along line 20—20 of FIG. 19.

A cable means 152 provides a electrical signal transmission to the electronics package 154. As shown in FIG. 20, sockets 156, 158 provide connections to an AC adapter and computer (not shown).

Figure 25:
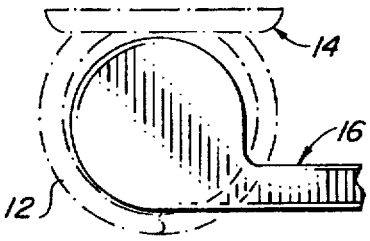
FIG. 25 is an end view of alternate embodiment of a document scanner, in accordance with the principles of the present invention.
Figure 19:
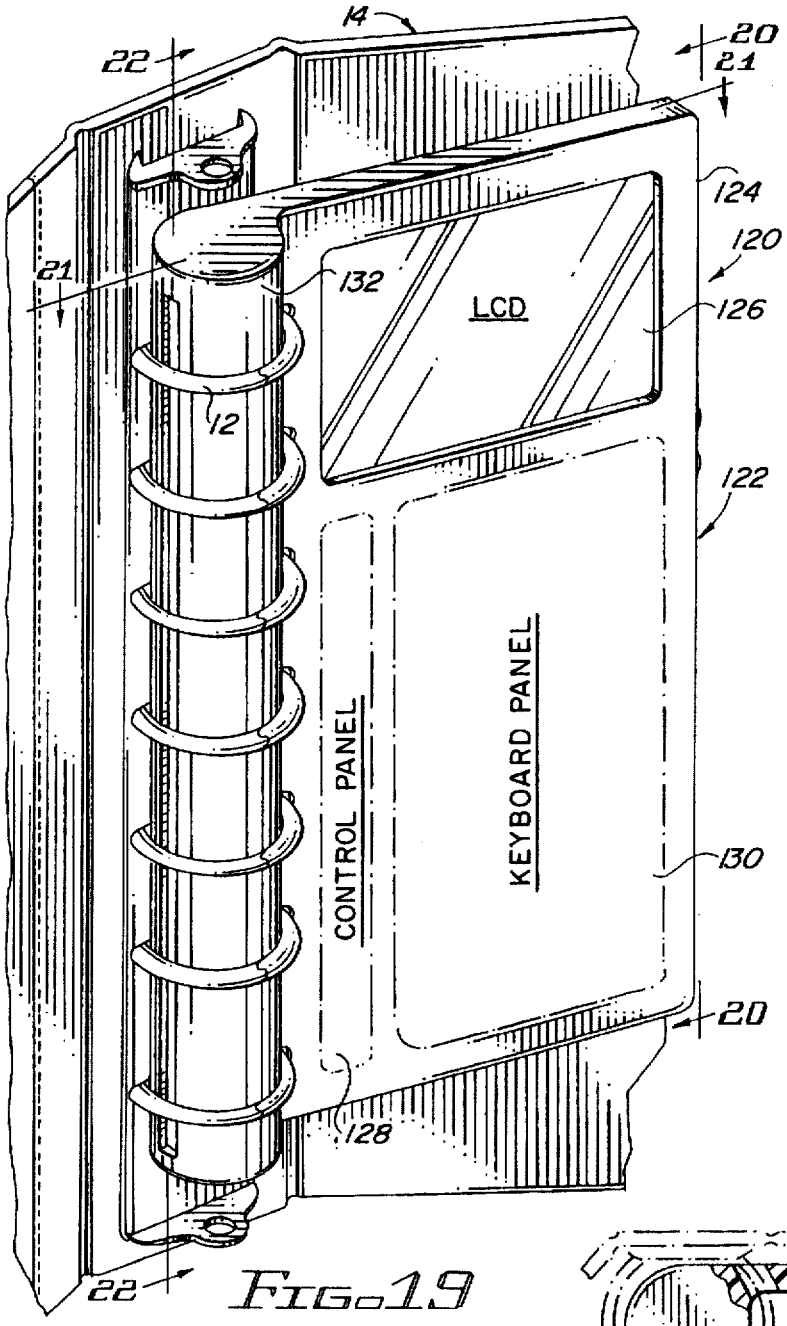
FIG. 19 is a perspective view of an embodiment of the present invention wherein a document scanner is stored in the volume within the rings.
Figure 21:
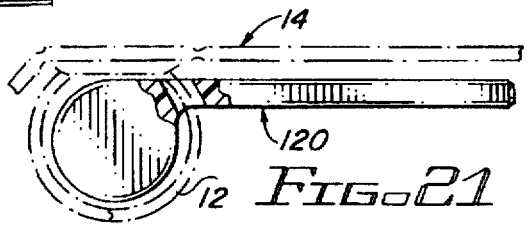
FIG. 21 is an end view taken along Line 21—21 of FIG. 19.
Figure 22:
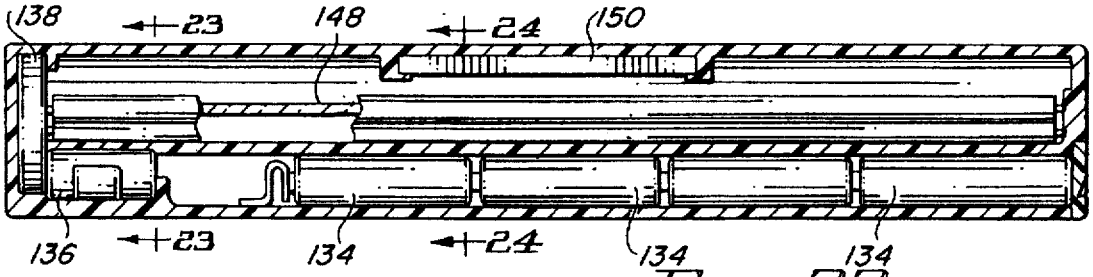
FIG. 22 is a cross section taken along Line 22—22 of FIG. 19.

In an alternate embodiment, illustrated in FIG. 25, the document scanner 160 is constructed to be positioned at the beginning of the ringed binder rather than at the end of the binder (i.e., contrast the orientation of the scanner 120 in FIG. 21 with the orientation shown of scanner 160 in FIG. 25).

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An apparatus for storing selected items in the volume formed within a plurality of rings of a ringed notebook or ringed binder, notebook or binder being of a type having a ring mechanism with a plurality of rings that open and close for holding paper and other selected items, a longitudinal axis extending through the center of the rings, said apparatus comprising:

a main plate member having a plurality of spaced openings therethrough, said spaced openings being so arranged and sled so as to accommodate the rings of a ringed notebook or ringed binder such that the main plate member is positioned parallel to said longitudinal axis when said main plate member is attached to said rings; and storage means for detachably storing at least one selected item, said storage including from said main plate member into the volume formed within the rings, wherein the volume, which is normally unused, can be utilized to store the selected item, wherein said storage means is rotatable relative to the rings to cooperate with the turning of any paper or other items in the ringed notebook or ringed binder means detachably stores said at least one selected item and wherein said storage means is positioned parallel to said longitudinal axis when said main plate member is attached to said rings.

2. The apparatus of claim 1, wherein storage means comprises a snap on holder.

3. The apparatus of claim 1, wherein said storage means comprises:

a) a storage plate member;

b) locking means associated with said storage plate member for securely attaching said storage plate member to said main plate member; and c) a storage item receiving element extending from a first end of said storage plate member wherein during use of said apparatus said storage item receiving element extends into the volume formed within the rings.

4. The apparatus of claim 3, wherein said locking means comprises:

a pair of tabs on a second end of said storage plate member for engagement with tabbed reception elements formed on a rear surface of said main plate member.

5. The apparatus of claim 4, wherein said locking means comprises: an edge receiving tab element positioned on said storage plate member for engagement with a portion of the edge of said main plate member.

6. The apparatus of claim 5, wherein said storage wherein said storage means is spaced from said plurality of spaced openings.

7. The apparatus of claim 3, wherein said storage item receiving element, comprises:

a pair of opposed, spaced, circular reel receiving elements, each having a central opening therethrough for receiving the selected item, said selected item being a post of a reel.

8. The apparatus of claim 3, wherein said storage item receiving element, comprises:

a pair of spaced, generally U-shaped cylinder receiving elements for receiving said selected item, the selected item having a cylindrical shape.

9. The apparatus of claim 3, wherein said storage item receiving element comprises:

a plurality of spaced arms for grasping the selected item.

10. The apparatus of claim 1, wherein the at least one selected item comprises a roll of material, a front surface of said main plate member having a cutting element formed therein.

11. The apparatus of claim 10, wherein the roll of material comprises a roll of tape, said cutting element having a serrated edge formed thereon.

12. The apparatus of claim 1, wherein said storage means comprises means for storing a small flashlight.

13. The apparatus of claim 1, wherein said storage means comprises means for storing a glue stick.

14. The apparatus of claim 1, wherein said storage means comprises means for storing a lipstick.

15. The apparatus of claim 1, wherein said comprises means for storing a writing instrument.

16. The apparatus of claim 1, wherein said storage means comprises means for storing a container.

17. The apparatus of claim 1, wherein said storage means comprises means for storing a recording device.

18. The apparatus of claim 1, wherein said storage means comprises means for storing a radio.

19. The apparatus of claim 1, wherein said storage means comprises means for storing a stapler.

20. The apparatus of claim 1, wherein said storage means comprises means for storing a portion of a document scanner.

21. The apparatus of claim 1, wherein said storage means comprises:

a plurality of integrally connected spaced arms for grasping a plurality of selected items.

22. The apparatus of claim 1, wherein said storage means is integrally connected to said main plate member.

23. The apparatus of claim 11, wherein rope from the roll of tape extends from the volume forward within the rings to said serrated edge.

24. The apparatus of claim 1, wherein said storage means comprises means for storing a cellular telephone.

25. The apparatus of claim 1, wherein said main plate member contains at least one relatively thin element of an electronic device, at least one relatively bulky element of said electronic device being contained in said storage means.

26. The apparatus of claim 1, wherein said main plate member contains at least one relatively thin element of a document scanner, at least one relatively bulky element of said document scanner being contained in said storage means.

27. The apparatus of claim 26, wherein said at least one relatively thin element comprises an LCD display, a keyboard panel, and a control panel.

28. The apparatus of claim 26, wherein said at least one relatively bulky element comprises a motor, a storage space for batteries, and a plurality of rollers.

29. An apparatus for storing batteries in the volume formed within a plurality or rings of a ringed notebook or ringed binder, said notebook or binder being of a type having a ring mechanism with a plurality of rings that open and close for holding paper and other selected items, a longitudinal axis extending through the center of the rings, said apparatus comprising:

a main plate member having a plurality of spaced openings therethrough, said spaced opening being so arranged and sized so as to accommodate the rings of a ringed notebook or ringed binder such that the main plate member is positioned parallel to said longitudinal axis when said main plate member is attached to said rings; and battery storage means for detachably storing at least one battery, said battery storage means depending from a side of said main plate member and being capable of being positioned in the volume formed within the rings when in use wherein the volume, which is normally unused, can be utilized to maintain the at least one battery, wherein said battery storage means is rotatable relative to the rings to cooperate with the turning of any paper or other items in the ringed notebook or ringed binder, wherein said storage means is spaced from said plurality of spaced openings and wherein said battery storage means is positioned parallel to said longitudinal axis when said main plate member is attached to said rings.

* * * * *

UNITED STATES PATENT AND TRADEMARK OFFICE

CERTIFICATE OF CORRECTION

PATENT NO. : 5,695,294

DATED : December 9, 1997

INVENTOR(S) : Mark A. Bedol, et al

It is certified that error appears in the above-identified patent and that said Letters Patent is hereby corrected as shown below:

Column 3, Line 65, delete "61" and substitute therefor -- 6l --.

Column 5, Line 31, after "binder," insert -- said --.

Column 5, Line 38, delete "sled" and substitute therefor -- sized --.

Column 5, Line 43, delete "detachably".

Column 5, Line 44, after "storage" delete "including" and substitute therefor -- means extending --.

Column 5, Line 50, extending to Line 51, after "ringed binder" delete "means detachably stores said at least one selected item" and substitute therefor --, wherein said storage means is spaced from said plurality of spaced openings --.

Column 6, Line 9, extending to Line 11, after "wherein said storage" delete "wherein said storage means is spaced from said plurality of spaced openings" and substitute therefor -- means detachably stores said at least one selected item --.

Column 6, Line 57, delete "rope" and substitute therefor -- tape --.

UNITED STATES PATENT AND TRADEMARK OFFICE

CERTIFICATE OF CORRECTION

PATENT NO. : 5,695,294

DATED : December 9, 1997

INVENTOR(S) : Mark A. Bedol, et al

It is certified that error appears in the above-identified patent and that said Letters Patent is hereby corrected as shown below:

Column 7, Line 11, after "a plurality" delete "or" and substitute therefor -- of --.

Column 7, Line 18, after "spaced" delete "opening" and substitute therefor -- openings --.

Column 8, Line 4, after "means for" delete "detachably".

Signed and Sealed this

Twenty-eighth Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,695,294

DATED : Dec. 9, 1997

INVENTOR(S) : Mark A. Bedol, et al

It is certified that error appears in the above-identified patent and that said Letters Patent is hereby corrected as shown below:

Column 6, Line 35, delete "stick".

Signed and Sealed this

Twenty-third Day of March, 1999

*Attest:*

Q. TODD DICKINSON

*Attesting Officer*

*Acting Commissioner of Patents and Trademarks*